US010119324B2

(12) United States Patent
Groff

(10) Patent No.: US 10,119,324 B2
(45) Date of Patent: Nov. 6, 2018

(54) FOLDING DOORS WITH RECEIVING CHANNEL AND LOCKING CLIP

(71) Applicant: LTL Wholesale, Inc., Schylkill Haven, PA (US)

(72) Inventor: Malcolm K. Groff, Orwigsburg, PA (US)

(73) Assignee: LTL Wholesale, Inc., Schuylkill Haven, PA (US)

( * ) Notice: Subject to any disclaimer, the term of this patent is extended or adjusted under 35 U.S.C. 154(b) by 7 days.

(21) Appl. No.: 15/239,727

(22) Filed: Aug. 17, 2016

(65) Prior Publication Data

US 2017/0130517 A1 May 11, 2017

Related U.S. Application Data

(60) Provisional application No. 62/205,949, filed on Aug. 17, 2015.

(51) Int. Cl.
*E06B 3/48* (2006.01)
*E05D 1/00* (2006.01)
(Continued)

(52) U.S. Cl.
CPC ..... *E06B 3/481* (2013.01); *E05B 65/0085* (2013.01); *E05C 19/16* (2013.01);
(Continued)

(58) Field of Classification Search
CPC . E06B 3/481; E06B 3/48; E06B 3/805; E06B 3/94; E06B 9/06; E05B 65/0085
(Continued)

(56) References Cited

U.S. PATENT DOCUMENTS 2,321,507 A * 6/1943 Oberdorfer ..... E06B 3/94 16/95 R
2,373,146 A * 4/1945 Shearer ..... E06B 3/94 160/160

(Continued)

FOREIGN PATENT DOCUMENTS

GB 596667 A * 1/1948 ..... E06B 3/94
GB 796595 A * 6/1958 ..... E06B 3/481

OTHER PUBLICATIONS

LTL Wholesale, Inc., "Oakmont/Encore Installation Instructions," U.S.A. Exact date unknown, but Applicant acknowledges it is prior to filing of provisional application.

*Primary Examiner* — Katherine W Mitchell
*Assistant Examiner* — Johnnie A. Shablack
(74) *Attorney, Agent, or Firm* — Ryder, Mazzeo & Konieczny, LLC

(57) ABSTRACT

An apparatus including a receiving channel and a locking clip for securing a folding door in a closed configuration. The receiving channel is mounted to a side of a door frame associated with a closed configuration of the folding door. The locking clip is mounted to the leading edge of the folding door. The locking clip includes sides that extend past sides of the leading edge of the folding door so as to create a ledge on each side thereof. The receiving channel includes cleats on inner walls thereof. The cleats engage the ledges to secure the locking clip within the receiving channel in a closed configuration. The locking clip may be mounted to a center of the leading edge. The receiving channel may traverse substantially the height of the door frame.

20 Claims, 8 Drawing Sheets

(51) Int. Cl.
*E05D 15/26* (2006.01)
*E05B 65/00* (2006.01)
*E05C 19/16* (2006.01)
*E05D 15/06* (2006.01)

(52) U.S. Cl.
CPC ..... *E05D 1/00* (2013.01); *E05D 15/26* (2013.01); *E05D 15/262* (2013.01); *E05D 15/0626* (2013.01)

(58) Field of Classification Search
USPC ..... 160/199, 206
See application file for complete search history.

(56) References Cited

U.S. PATENT DOCUMENTS 2,713,897 A * 7/1955 Teague ..... E05B 1/0015 16/412
2,732,894 A * 1/1956 Harris ..... E06B 3/94 16/93 R
2,795,272 A * 6/1957 McBerty ..... E05D 15/26 139/420 R
2,802,522 A * 8/1957 Collet ..... E06B 3/481 160/199
2,903,055 A * 9/1959 Merrill ..... E06B 3/94 160/84.11
2,913,045 A * 11/1959 Schesvold ..... E06B 3/481 160/84.11
3,006,409 A * 10/1961 Pemberton ..... E06B 3/94 160/386
3,033,283 A * 5/1962 Jorgensen ..... E06B 3/481 160/183
3,040,806 A * 6/1962 Merrill ..... B61D 19/008 160/199
3,073,382 A * 1/1963 Zimmerman ..... E06B 3/481 156/257
3,082,817 A * 3/1963 Merrill ..... E06B 3/94 160/40
3,156,293 A * 11/1964 Reynolds ..... E06B 7/2309 160/40
3,223,147 A * 12/1965 Holloway ..... E06B 3/94 160/84.09
3,331,427 A * 7/1967 Colombo ..... E05D 3/12 160/199
3,348,628 A * 10/1967 Dixon ..... E06B 3/94 160/40
3,405,756 A * 10/1968 Harris ..... E06B 3/481 160/183
3,416,282 A * 12/1968 Daugherty ..... A47B 95/04 428/122
3,481,388 A * 12/1969 Smart ..... E06B 3/94 160/206
3,494,408 A * 2/1970 Ercole ..... E05D 15/264 160/118
3,509,934 A * 5/1970 Smart ..... E06B 3/94 16/107
3,670,797 A * 6/1972 Sassano ..... E05D 15/26 160/118
3,672,424 A * 6/1972 Brown ..... E06B 3/481 160/199
3,708,009 A * 1/1973 Viol ..... E06B 3/94 160/84.09
3,720,255 A * 3/1973 Ueda ..... E06B 3/481 160/199
3,789,906 A * 2/1974 Viol ..... E06B 3/481 160/199
3,799,237 A * 3/1974 Proserpi ..... E06B 3/481 160/199
3,850,223 A * 11/1974 Tompkins ..... E06B 3/94 160/235
3,972,365 A * 8/1976 Dixon ..... E06B 3/481 160/183
4,006,569 A * 2/1977 Kain ..... E06B 3/5454 52/204.591
4,228,841 A * 10/1980 Dixon ..... E05D 1/04 160/183
4,379,479 A * 4/1983 Whiting ..... B60J 5/08 16/97
4,386,645 A * 6/1983 Dever ..... E05D 1/04 16/355
4,497,357 A * 2/1985 Labelle ..... E05D 1/04 160/183
4,658,878 A * 4/1987 Williams ..... E06B 3/94 160/84.09
4,660,613 A * 4/1987 Dagenais ..... E05D 15/26 160/183
4,834,161 A * 5/1989 Johnson ..... E05B 65/087 160/118
4,848,436 A * 7/1989 Dagenais ..... E05D 15/26 160/118
4,850,144 A * 7/1989 Grisham ..... E06B 3/08 49/482.1
4,924,929 A * 5/1990 Johnson ..... E05B 65/087 160/118
4,991,257 A * 2/1991 Eutebach ..... E05D 15/0613 104/246
5,097,883 A * 3/1992 Robinson ..... E05D 15/26 160/118
5,181,296 A * 1/1993 Williams ..... E05D 15/0613 104/94
RE34,360 E * 8/1993 Carlson ..... E05F 15/605 160/118
5,269,619 A * 12/1993 Warkus ..... F16B 7/0473 403/20
D346,032 S * 4/1994 Colson ..... D25/119
5,472,037 A * 12/1995 Hoffman ..... E05D 7/009 160/118
5,477,903 A * 12/1995 Figueiredo ..... E06B 5/003 160/183
5,549,148 A * 8/1996 Figueiredo ..... E06B 5/003 160/183
5,551,499 A * 9/1996 McRoberts ..... E06B 7/20 160/199
5,601,130 A * 2/1997 Werner ..... E06B 9/0638 160/118
5,701,941 A * 12/1997 Pasternak ..... E05D 15/26 16/87 R
5,755,270 A * 5/1998 Knezevich ..... E05B 65/0085 160/118
5,816,309 A * 10/1998 Paradise ..... E05B 15/022 16/86 R
5,822,810 A * 10/1998 Chen ..... A47K 3/362 4/607
5,918,659 A * 7/1999 Lee ..... E06B 3/481 160/199
6,021,839 A * 2/2000 Knezevich ..... E06B 3/481 160/118
6,122,868 A * 9/2000 Knezevich ..... E06B 9/0669 160/183
6,176,292 B1 * 1/2001 Norton, II ..... E05D 15/264 160/118
6,182,738 B1 * 2/2001 Chen ..... A47K 3/362 160/199
6,220,332 B1 * 4/2001 Lai ..... A47K 3/362 160/199
6,253,826 B1 * 7/2001 Witter ..... E06B 3/481 160/213
6,296,038 B1 * 10/2001 Chen ..... E06B 3/481 160/118
6,325,135 B1 * 12/2001 Lee ..... H02K 3/04 160/199
6,330,902 B1 * 12/2001 Chen ..... E06B 3/481 160/199
6,345,476 B1 * 2/2002 Hill ..... E06B 9/02 160/118
6,702,259 B2 * 3/2004 Pratt ..... E04F 11/181 256/19

(56) References Cited

U.S. PATENT DOCUMENTS

| | | | | |
|---|---|---|---|---|
| 6,786,021 | B1 * | 9/2004 | Chen | E06B 3/481 160/236 |
| 7,370,685 | B2 * | 5/2008 | Moriya | E06B 9/54 160/120 |
| 7,472,482 | B2 * | 1/2009 | Pratt | E04F 11/181 29/897.35 |
| 7,845,384 | B2 * | 12/2010 | Goodman | E05B 65/0085 160/118 |
| 8,167,275 | B1 * | 5/2012 | Bizzarri | E04F 11/181 256/65.02 |
| 8,522,853 | B2 * | 9/2013 | Coleman | E05B 65/104 160/118 |
| 8,567,472 | B2 * | 10/2013 | Stewart | F16P 3/02 160/199 |
| D726,340 | S * | 4/2015 | Kleiman | D25/48.4 |
| 9,322,203 | B2 * | 4/2016 | Kleiman | E05D 15/26 |
| 9,353,568 | B2 * | 5/2016 | Knight | E05F 15/643 |
| 9,428,259 | B2 * | 8/2016 | Savian | E06B 3/805 |
| 9,458,667 | B2 * | 10/2016 | Bugh | E06B 11/02 |
| 9,587,424 | B2 * | 3/2017 | Svenson | E04B 2/7872 |
| 9,650,823 | B2 * | 5/2017 | Svenson | E05D 15/0652 |
| 2011/0073824 | A1 * | 3/2011 | Lappin | E04F 11/1817 256/65.08 |
| 2013/0081333 | A1 * | 4/2013 | Stewart | E05D 15/12 49/404 |
| 2014/0366321 | A1 * | 12/2014 | Chen | E05D 7/009 16/225 |
| 2015/0247341 | A1 * | 9/2015 | Bizzarri | E04F 11/181 256/65.02 |
| 2017/0130517 | A1 * | 5/2017 | Groff | E06B 3/481 |

* cited by examiner

FOLDING DOORS WITH RECEIVING CHANNEL AND LOCKING CLIP

PRIORITY

This application claims the priority under 35 USC § 119 of Provisional Application 62/205,949 filed on Aug. 17, 2015, entitled "Folding Door with Receiving Channels and Corresponding Locking Clips" and having Malcolm K. Groff as inventor. Application 62/205,949 is herein incorporated by reference in its entirety.

BACKGROUND

Doors are used to divide areas and/or to enclose spaces. Standard doors are mounted on one side of an opening and pivot from an open position to a closed position. The area that the door is utilized in needs to be of ample size to allow the door to pivot between the open and closed position and to not have any furnishings that may get in the way of this pivoting. Folding doors provide the functionalities of space enclosure and/or division without the need for as much space for the pivoting of the door. Folding doors are generally comprised of a series of sections of a prescribed width with connectors, such as hinges, or bendable material, that facilitate the sections folding onto and against one another to open and close the door. Folding doors are often a cost-effective alternative to other types of doors. They are relatively less expensive, use less materials, and can be installed without the aid of an expert. Nonetheless, they can be manufactured to be just as visually appealing and functional as regular doors. Folding doors provide similar levels of space, sound, and sight division as other types of doors, and can even provide added functionality and benefits by nature of their flexibility and ease of installation.

To minimize their spacial footprint, a folding door is typically affixed to one side of a door frame and is operated by being pulled side-to-side within the frame to open and close by the user. By its nature, however, a folding door is more difficult to keep in a closed position because it is less structurally stable for being comprised of folding panels. Dissimilar to a traditional door that opens outward or inward in relation to the user, folding doors cannot be kept closed with traditional bolt-type locks. One method of keeping folding doors closed is reliance on their structural stability to keep the door in a certain position. However, this method fails to work with doors that include bendable material instead of hinges as connectors between the panels due to the material's tendency to fold if the door is not locked in place.

A folding door may also be kept closed by magnets, one or more of which would be attached to the leading edge of the folding door and upon contact with a metal strip affixed to the opposite side of the door frame, keep the door in the locked position until pulled apart. However, varying temperatures cause magnets to weaken over time such that they would eventually cease to adhere to the metal strip and need to be replaced. The metal strip in the door frame is also susceptible to rust and wear through use, inhibiting its functionality and appearance. Furthermore, the need for metallic parts makes the folding door overall more expensive to manufacture and maintain for the user.

What is needed is a more cost-effective alternative to keeping folding doors closed that preserves the benefits and functionalities of a folding door, but is easier to maintain, replace, and just as simple to use.

DETAILED DESCRIPTION

Figure 1:
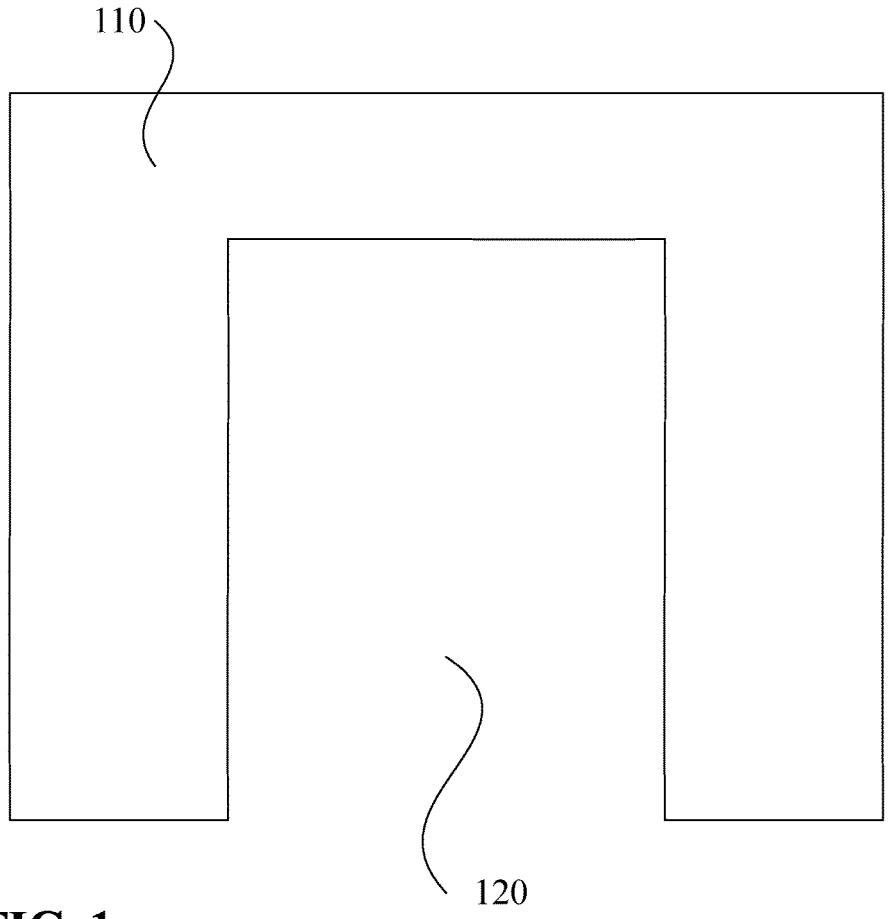
FIG. 1 illustrates an example wall having an opening, such as a door opening, formed therein, according to one embodiment.

FIG. 1 illustrates an example wall 110 having an opening, such as a door opening, 120 formed therein. The opening 120 is where a door would be mounted to be able to pivot so as to open or close off the opening 120.

Figure 2A:
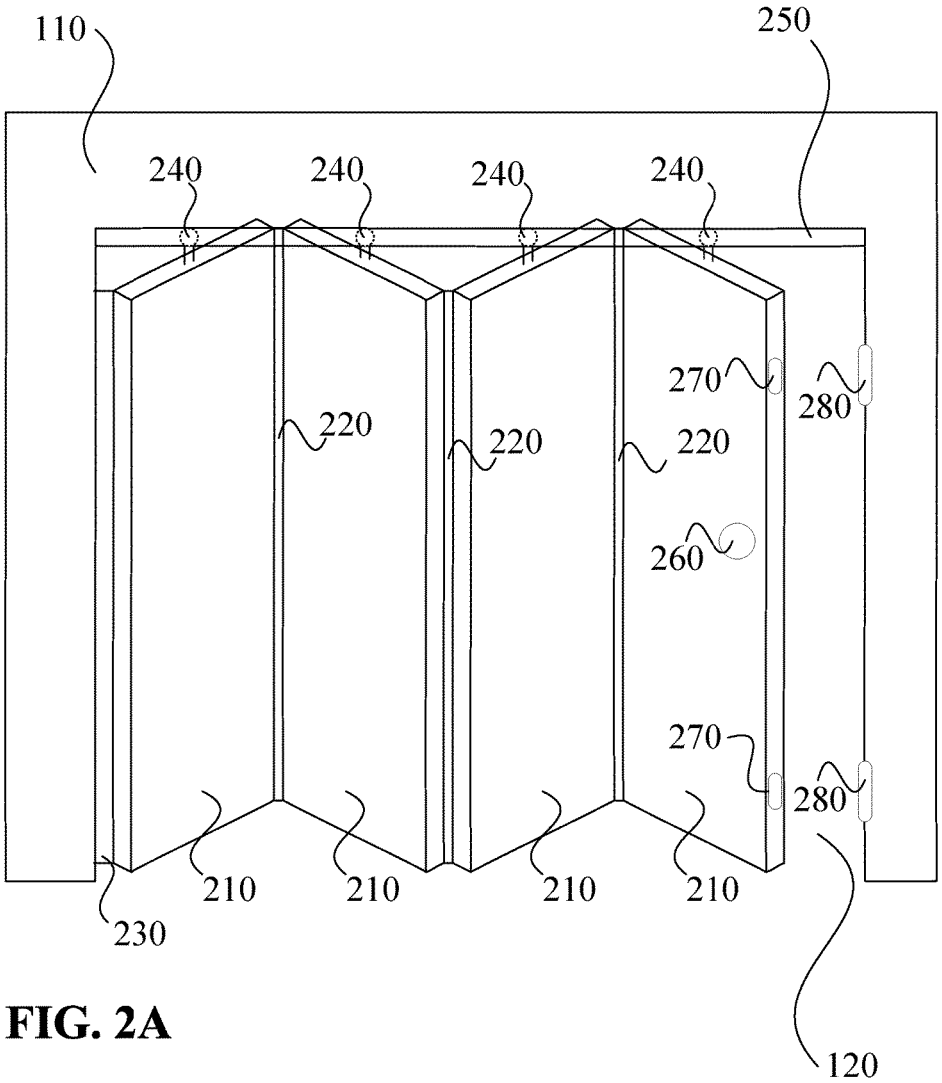
FIGS. 2A-C illustrate the use of an example folding door within the door opening of FIG. 1, according to one embodiment.
Figure 2B:
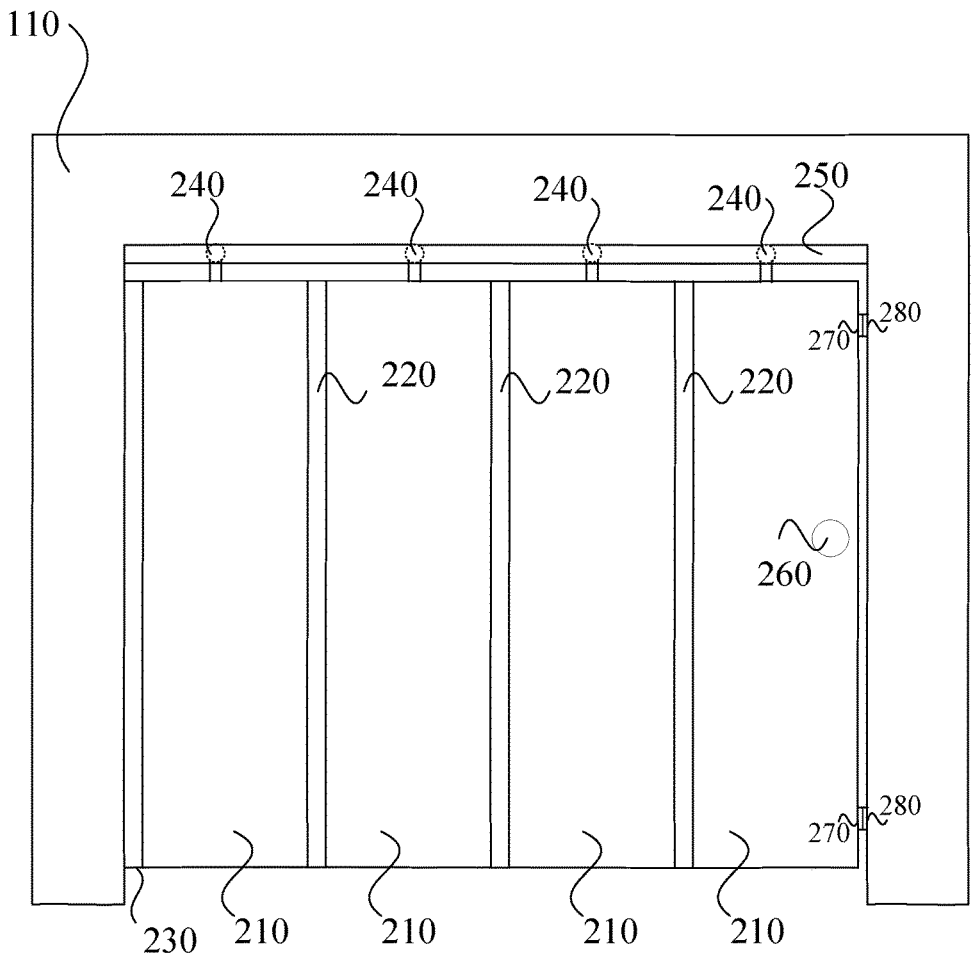
Figure 2C:
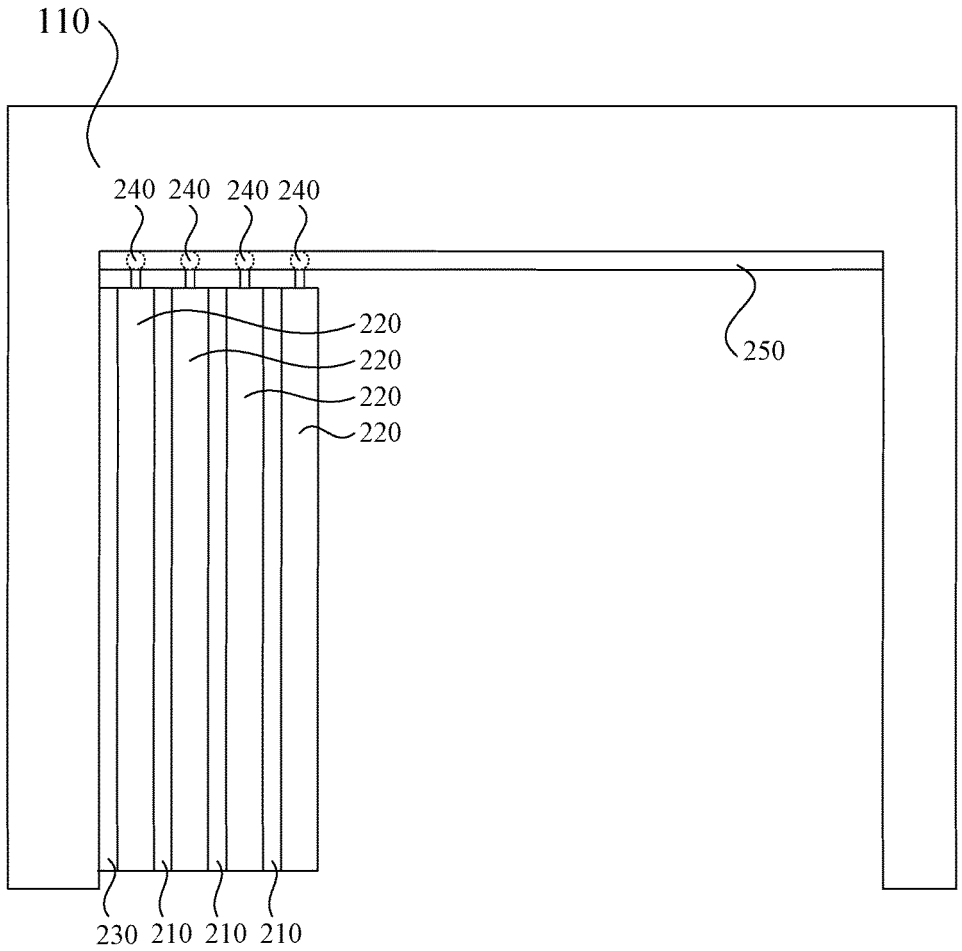

FIGS. 2A-C illustrates the use of a folding door within the opening 120. FIG. 2A illustrates the folding door in a configuration between open and closed, FIG. 2B illustrates the folding door in a closed configuration and FIG. 2C illustrates the folding door in an open configuration.

The folding door is comprised of a plurality of panels 210 that are connected together via connection means 220. The number of panels 210 and the dimensions of the panels 210 may vary to accommodate different door frame sizes (e.g., height and width). According to one embodiment, the panels 210 are made of a relatively light weight material. The panels may be made from a material, including but not limited to, plastic, wood, vinyl, or some combination thereof. The connection means 220 are configured to enable the panels 210 to extend from one another or fold in against one another. It should be noted that the connection means 220 will alternate the manner in which they enable adjoining panels 210 to pivot such that the panels 210 can fold together and extend from one another appropriately. As the panels 210 can pivot with respect to each other one edge of the panels may extend past a door frame in one direction while the other edge may extend past the door frame in the other direction.

According to one embodiment, the panels 210 may have substantially the same dimensions so that they can fold against each other in an open configuration. As the panels 210 that connect to the door frames only pivot in one direction, these panels may be approximately half the width of the other panels and only extend in one direction from the door frame in a closed configuration. It should be noted that for ease of illustration each of the panels is illustrated as having the same dimensions.

The connection means 220 could be one or more connectors, such as a hinges. According to one embodiment, the connection means 220 is a bendable material that holds the panels 210 together but enables the panels 210 to extend from one another or fold in against one another. The bendable material may be selected from a variety of bendable materials, such as plastic or vinyl. As illustrated, the connection means 220 is a single component that extends the height of the panels 210, but is in no way limited thereto. Rather, the connection means 220 could be a plurality of components and/or could take up only a portion of the height of the panels 210 without departing from the current scope of the invention.

The folding door includes a mountable (fixed) edge and a moveable (leading) edge. The door's fixed edge is attached to one side of the door frame to mount the folding door. The mounting of the fixed edge enables the folding door to be pulled to the opposite side to extend the width of the door frame, without the folding door shifting inward, outward, or sideways. The fixed edge may be attached to the door frame with a connection means 230. The connection means 230 may be one or more connectors (e.g., hinges) or a bendable material, much like the connection means 220. The connection means 230 enables an adjacent panel 210 to extend from the door frame or to fold in against the door frame. The connection means 230 may provide a permanent connection to the door frame using for example, screws, nails, or adhesive. The connection means 230 may provide a temporary or detachable connection to the door frame using, for example, clips within a channel.

Figure 3A:
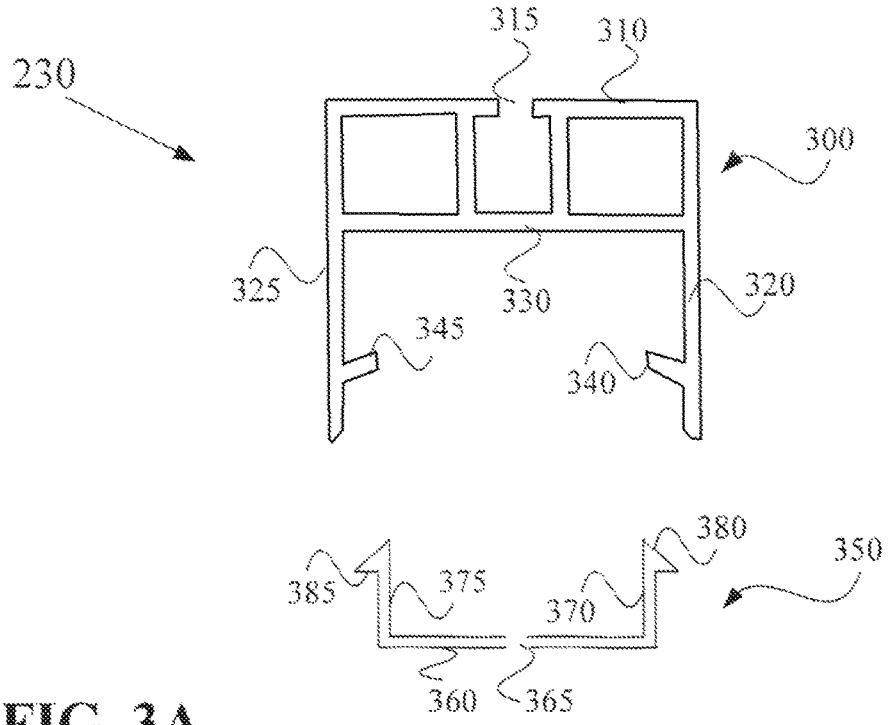
FIGS. 3A-B illustrate top views of an example connection means between a fixed edge of the folding doors and a door frame, according to one embodiment.
Figure 3B:
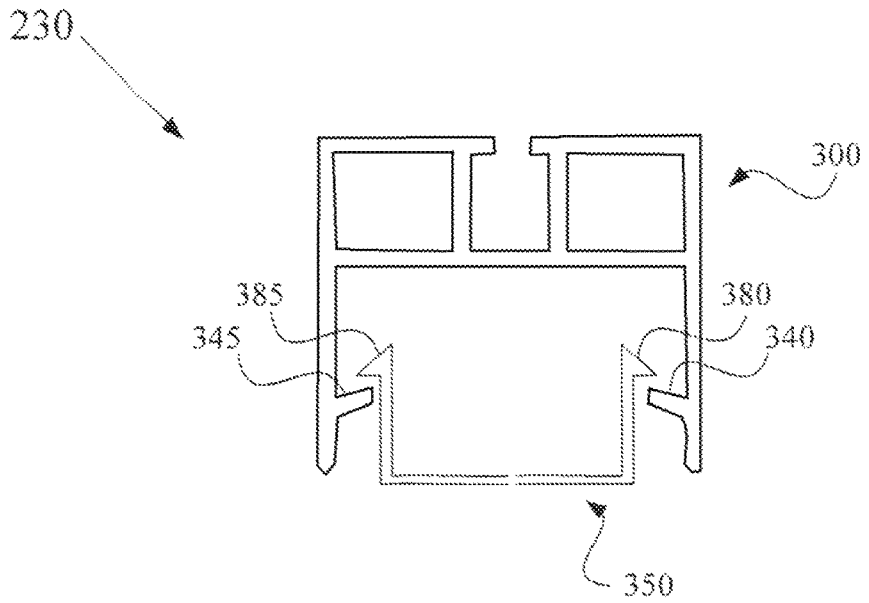

FIGS. 3A-B illustrate top views of an example connection means 230 in an unconnected (FIG. 3A) and a connected (FIG. 3B) configuration, according to one embodiment. The connection means 230 includes a mounting channel 300 mounted to a panel (the panel is not illustrated for ease of illustration) and one or more mounting clips 350 mounted to the door frame (the door frame is not illustrated for ease of illustration). The mounting channel 300 may be rectangular in shape and include a bottom 310, two sides 320, 325 and an open top (not separately labeled). The bottom 310 is to contact the panel and may include an opening 315 to enable one or more screws (not illustrated) to be used to secure the channel 300 to the panel. The mounting channel 300 may include a middle 330 that includes holes (not visible) that enables the screws to enter the opening 315. The sides 320, 325 may include cleats 340, 345 extending inward therefrom. The cleats 340, 345 may be oriented slightly angled downward towards the bottom 310 to allow them to better catch onto the one or more mounting clips 350 and hold them in place. According to one embodiment, the mounting channel 300 may span the height of the panel (such an embodiment provides an aesthetic look). The mounting channel 300 is in no way limited to being the same height as the panel.

The one or more mounting clips 350 may also be rectangular in shape. The number and height of the mounting clips 350 may vary without departing from the current scope. Each of the one or more mounting clips 350 may include a bottom 360, two sides 370, 375 and an open top (not separately labeled). The bottom 360 is to contact the door frame and may include an opening 365 to enable a screw (not illustrated) to be used to secure the clip 350 to the door frame. The sides 370, 375 may include cleats 380, 385 extending outward therefrom.

The one or more mounting clips 350 are configured so as to be smaller than the mounting channel 300 so as to fit within the mounting channel 300. When within the mounting channel 300, the cleats 380, 385 engage with the cleats 340, 345 to secure the mounting channel 300 and the mounting clips 350 together and also to secure the folding door to the door frame.

According to an alternative embodiment, the one or more mounting clips 350 may be connected to a panel and the mounting channel 300 may be connected to the door jam. The one or more mounting clips 350 may be secured within the mounting channel 300 in order to secure the fixed edge of the folding door to the door frame.

Referring back to FIGS. 2A-C, each of the panels 210 of the folding door includes a wheel assembly 240 extending from the top thereof. According to one embodiment, the wheel assembly 240 includes a shaft (not separately identified) extending upward from the panel 210 and a wheel (not separately identified) extending laterally therefrom. The folding door system further includes a track 250 mounted to a top of the door frame to receive the wheel assemblies 240. When the wheel assemblies 240 are secured in the track 250 they secure the folding door so a lower edge of each panel 210 is secured above the floor. The track 250 may span the width of the door frame, or be shorter than its width. According to one embodiment, the track 250 is generally rectangular in shape. According to one embodiment, the track 250 includes a groove on a lower edge, is hollow in the center so as to create a pathway and is open at both ends in order to receive the wheel assemblies 240. The wheels of the wheel assemblies 240 rotates within the pathway and the shafts of the wheel assemblies 240 traverse the grove. The wheel assemblies 240 movement with the track 250 facilitates the door's movement side-to-side when the door is pulled to one side.

According to one embodiment, the wheels of the wheel assemblies 240 are horizontally oriented. According to one embodiment, the wheel assemblies 240 are attached to the door's top edge using clips. According to one embodiment, the shaft is a screw that is threaded through the wheel and then screwed into an edge (e.g., top edge) of the panels 210.

The last panel 210 from the fixed edge includes a handle 260 that can be used to open and close the folding door. The handle 260 is illustrated as a knob (circular) for ease of illustration but is in no way limited thereto. The last panel 210 also acts as the leading edge of the folding door. In order to keep the folding door in a closed configuration, the leading edge may be temporarily (removably) affixed to the door frame in some manner. The leading edge (panel 210) may include magnets 270 affixed thereto at certain locations and the door fame may have pieces of metal 280 mounted thereto in alignment with the magnets 270. Alternatively, the magnets 270 may be mounted to the door frame and the metal 280 may be mounted to the panel 210.

As noted above, the use of magnets 270 and metal 280 is not preferable as it increases the cost and may have performance issues. Furthermore, it may not be aesthetically pleasing looking as it may result in a gap between the edge of the moveable edge and the door frame and the magnets 270 and metal 280 may be visible in that gap (illustrated in FIG. 2B).

Accordingly, another manner for temporarily affixing the leading edge of the folding doors to the door frame in a closed configuration is desired. The manner is preferably cheaper, does not have the potential performance degradation of the magnets 270 and the metal 280 and covers the gap between the edge of the leading edge and the door frame to provide a more aesthetically pleasing look.

According to one embodiment, a receiving channel may be secured to the door frame and a connector (locking clip) may be secured to the leading edge (end of the last panel).

The connector may be able to be secured within the channel so as to keep the folding door in a closed configuration. The connector and the leading edge may be secured within the channel so they are not seen and there is not gap present.

Figure 4:
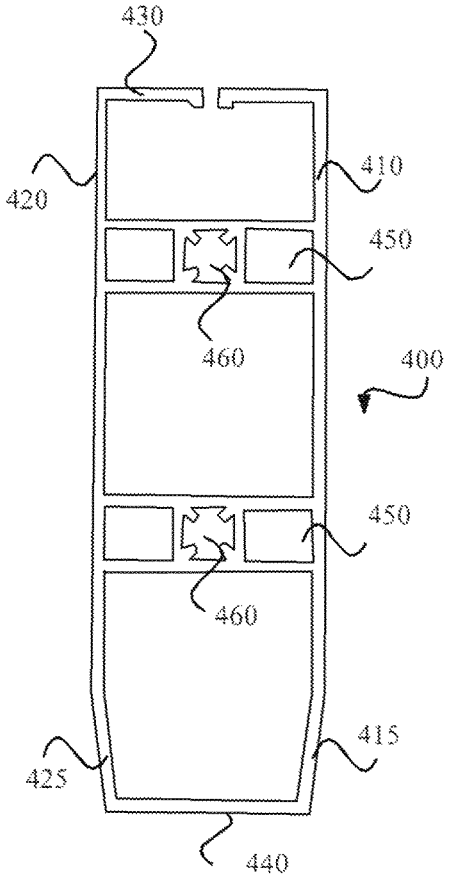
FIG. 4 illustrates a top cross sectional view of a last panel (leading edge) of the folding door, according to one embodiment.

FIG. 4 illustrates a top cross sectional view of a last panel 400 (leading edge). The panel 400 may have a generally rectangular cross section. The panel includes sides 410, 420, a back 430 and a front 440. The front 440 may be slightly smaller than the back 430 and as such the sides 410, 420 may taper in as they approach the front 440 (have angled portions 415, 425). The panel 400 may have a substantially hollow interior but may include braces 450 running between the sides 410, 420 at defined locations for support. According to one embodiment, the braces 450 may be configured with a receptacle 460 to receive a screw or the like. For example, the receptacle 460 may be capable of receiving the shaft of the wheel assemblies 240.

Figure 5:
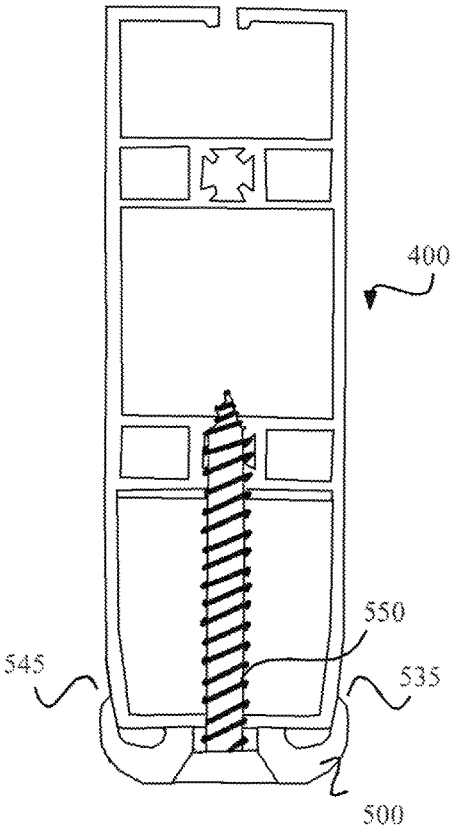
FIG. 5 illustrates a connector (locking clip) being mounted to a front of the leading edge panel, according to one embodiment.

FIG. 5 illustrates a connector 500 (locking clip) being mounted to a front 440 of the leading edge panel 400. The connector 500 is mounted to the leading edge panel with, for example, a screw 550. The connector 500 extends over the angled sides 415, 425 so as to create edges 535, 545 that can be secured within the channel mounted to the door frame.

Figure 6A:
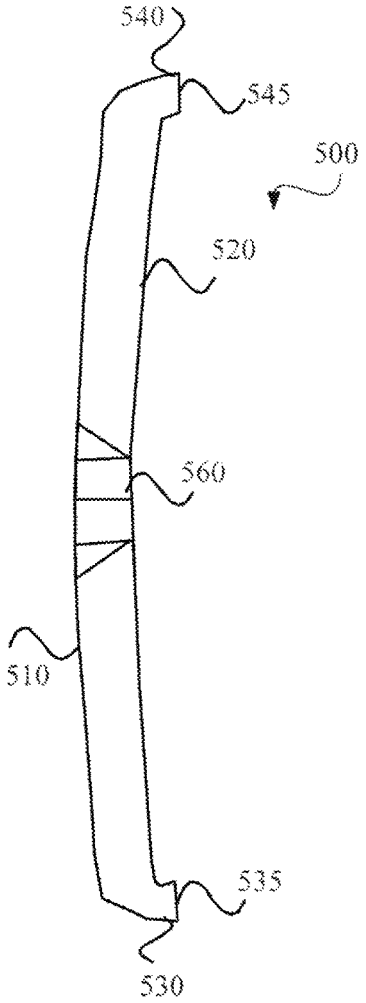
FIGS. 6A-C illustrate side, back and top views of the connector of FIG. 5, according to one embodiment.
Figure 6B:
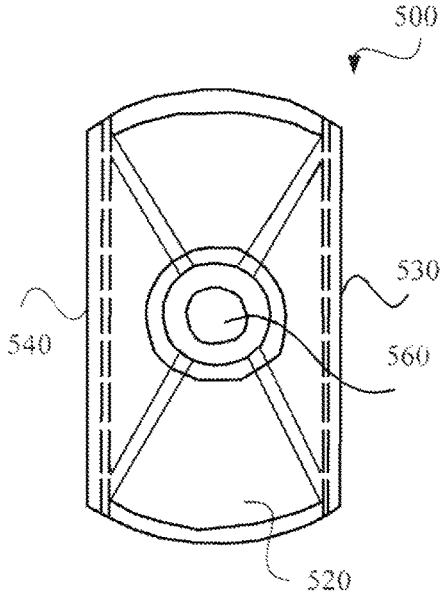
Figure 6C:
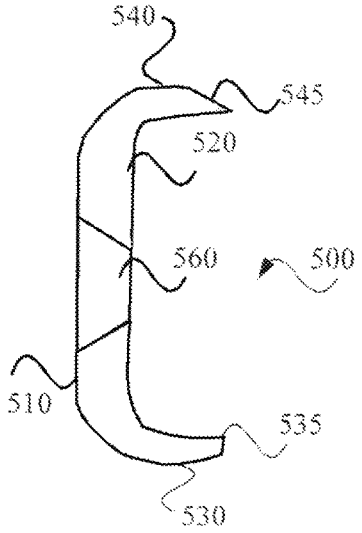

FIGS. 6A-C illustrate side, back and top views of the connector 500. The connector 500 is generally rectangular in shape with rounded edges. The connector 500 includes a front face 510, a back face 520 and side walls 530, 540. The back face 520 abuts against the edge of leading edge panel 400 (the panel 400 is not illustrated in FIGS. 6A-C). The side walls 530, 540 extend over the angled sides 415, 425 (the angled sides 415, 425 are not illustrated in FIGS. 6A-C) so as to create the edges 535, 545 used to secure the connector within the channel. The connector 500 includes a hole 560 formed through the front face 510 and the back face 520 for receiving, for example, the screw 550.

Figure 7:
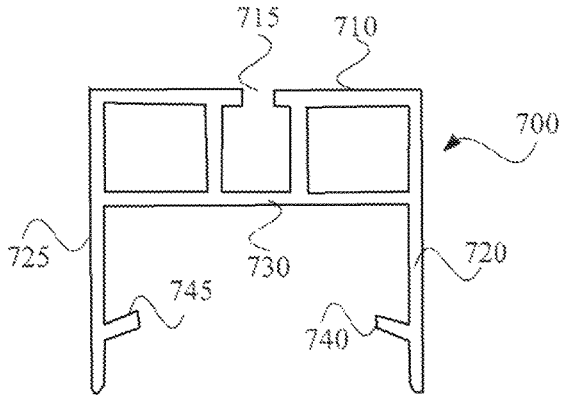
FIG. 7 illustrates an example channel to be mounted to a door frame in order to receive the leading edge of the folding door, according to one embodiment.

FIG. 7 illustrates an example channel 700 to be mounted to a door frame in order to receive the leading edge of the folding door. The channel 700 may be similar to the channel 300 illustrated in FIG. 3 for securing the fixed edge of the folding door. The channel 700 may be rectangular in shape and include a bottom 710, two sides 720, 725 and an open top (not separately labeled). The bottom 710 is to contact the door frame and may include an opening 715 to enable one or more screws (not illustrated) to be used to secure the channel 700 to the door frame. The channel 700 may include a middle 730 that includes holes (not visible) that enables the screws to enter the opening 715. The sides 720, 725 may include cleats 740, 745 extending inward therefrom. According to one embodiment, the channel 700 may span the height of the door frame (such an embodiment provides an aesthetic look). The channel 700 is in no way limited to being the same height as the door frame.

Figure 8:
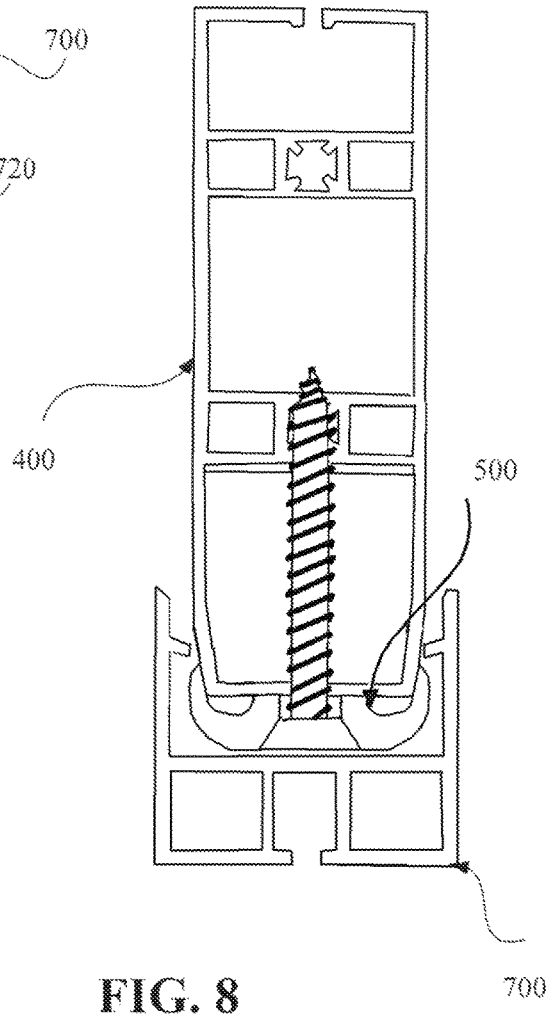
FIG. 8 illustrates the leading edge panel with connector of FIG. 5 being received within the channel of FIG. 7, according to one embodiment.

FIG. 8 illustrates the connector 500 mounted to the leading edge panel 400 being received within the channel 700. When the leading edge panel 400 enters the channel 700 the edges 535, 545 of the connector 500 engage with the cleats 740, 745 of the channel 700 to secure the folding door in a closed position. As the edges 535, 545 are rounded rather than tapered the connection can easily be broken and the folding door can be open by applying a little pressure.

According to one embodiment, a single connector 500 may be utilized to secure the leading edge panel 400 within the channel 700 to keep folding door in a closed configuration. The connector 500 may be located in the middle of the leading edge panel 400 (e.g., at the location of the handle 260). Alternatively, more than one connector 500 may be used and the location of the connector 500 may vary without departing from the current scope.

Although the disclosure has been illustrated by reference to specific embodiments, it will be apparent that the disclosure is not limited thereto as various changes and modifications may be made thereto without departing from the scope. Reference to "one embodiment" or "an embodiment" means that a particular feature, structure or characteristic described therein is included in at least one embodiment. Thus, the appearances of the phrase "in one embodiment" or "in an embodiment" appearing in various places throughout the specification are not necessarily all referring to the same embodiment.

The various embodiments are intended to be protected broadly within the spirit and scope of the appended claims.

What is claimed is:

1. A folding door system comprising:

a plurality of panels, wherein adjacent pairs of the plurality of panels are pivotally connected to one another in order to enable the plurality of panels to fold against one another when pushed in a first direction and to extend from each other when pulled in a second direction, wherein the plurality of panels pivotally connected together is a folding door;

a connection means to pivotally secure a fixed edge of the folding door to a first side of a door frame;

a plurality of wheel assemblies, wherein the wheel assemblies are mounted to an upper edge of the panels;

a track mounted to an upper edge of a door frame, wherein the track is to receive the wheel assemblies to enable the folding door to move back and forth from an open configuration to a closed configuration;

a receiving channel mounted to a second side of the door frame, wherein the receiving channel is to receive a leading edge of the folding door when the folding door is in a closed configuration, wherein the receiving channel includes cleats on inner walls thereof; and a locking clip mounted to the leading edge of the folding door, wherein the locking clip includes a front face and side walls, wherein the front face abuts a front face of the leading edge and the side walls abut sides of the leading edge, wherein edges are formed along the sides of the leading edge at points where side walls of the locking clip end, wherein the locking clip is to be received in the receiving channel when the folding door is in the closed configuration, wherein when the leading edge is within the receiving channel the edges are engaged by the cleats in order to secure the leading edge within the receiving channel.

2. The system of claim 1, wherein the locking clip is mounted to the leading edge at a position that is substantially centered along height of the leading edge.

3. The system of claim 1, wherein the locking clip is secured to the leading edge with a screw.

4. The system of claim 1, wherein the adjacent pairs of the plurality of panels are pivotally connected with hinges.

5. The system of claim 1, wherein the adjacent pairs of the plurality of panels are pivotally connected with flexible material.

6. The system of claim 1, wherein the connection means includes a mounting channel and at least one mounting clip.

7. The system of claim 6, wherein the at least one mounting clip includes cleats on outer walls thereof and the mounting channel includes cleats on inner walls thereof and the cleats engage one another when the at least one mounting clip is inserted into the mounting channel.

8. The system of claim 6, wherein the mounting channel is affixed to the folding door and the one or more mounting clips are affixed to the first side of the door frame.

9. The system of claim 6, wherein the receiving channel and the mounting channel are substantially identical components.

10. The system of claim 1, wherein the wheel assemblies include a shaft and a wheel.

11. The system of claim 10, wherein the wheel is horizontally oriented and the shaft is a screw that is threaded through the wheel and secured to an upper edge of the plurality of panels.

12. An apparatus for securing a folding door in a closed configuration, the apparatus comprising:

a folding door;

a receiving channel mounted to a side of a door frame associated with a closed configuration of the folding door, wherein the receiving channel is to receive a leading edge of the folding door when the folding door is in a closed configuration, wherein the receiving channel includes cleats on inner walls thereof; and a locking clip mounted to the leading edge of the folding door, wherein the locking clip includes a front face and side walls, wherein the front face abuts a front face of the leading edge and the side walls abut sides of the leading edge, wherein edges are formed along the sides of the leading edge at points where side walls of the locking clip end, wherein the locking clip is to be received in the receiving channel when the folding door is in the closed configuration, wherein when the leading edge is within the receiving channel the edges are engaged by the cleats in order to secure the leading edge within the receiving channel.

13. The apparatus of claim 12, wherein the locking clip is mounted to the leading edge at a position that is substantially centered along height of the leading edge.

14. The apparatus of claim 12, wherein the locking clip is secured to the leading edge with a screw.

15. The apparatus of claim 12, wherein a transition from the front face to the side walls has a rounded profile to enable a smooth entry into the receiving channel.

16. The apparatus of claim 12, wherein the side walls are tapered inward to enable the leading edge to be removed from the receiving channel.

17. An apparatus for securing a folding door in a closed configuration, the apparatus comprising:

a locking clip configured to be mounted to a leading edge of a folding door, wherein the locking clip includes a front face and side walls, wherein the front face is configured to abut a front face of the leading edge and the side walls are configured to abut sides of the leading edge, wherein edges are formed along the sides of the leading edge at points where side walls of the locking clip end; and a receiving channel mounted to a side of a door frame, wherein the receiving channel is configured to receive the leading edge of the folding door when the folding door is in a closed configuration, wherein the receiving channel includes cleats on inner walls thereof, wherein the receiving channel is configured such that when the leading edge is within the receiving channel the edges are engaged by the cleats in order to secure the leading edge within the receiving channel.

18. The apparatus of claim 17, wherein the locking clip is configured to be mounted to the leading edge at a position that is substantially centered along height of the leading edge.

19. The apparatus of claim 17, wherein a transition from the front face to the side walls has a rounded profile to enable a smooth entry into the receiving channel.

20. The apparatus of claim 17, wherein the side walls are tapered inward to enable the leading edge to be removed from the receiving channel.

* * * * *